United States Patent [19]

Kniesel

[11] Patent Number: 4,957,391

[45] Date of Patent: Sep. 18, 1990

[54] APPARATUS FOR SETTING MARKER PLUGS

[76] Inventor: Ulrich Kniesel, Franz-Lehar-Strasse 7, A-4540 Bad Hall, Austria

[21] Appl. No.: 343,071

[22] Filed: Apr. 25, 1989

[30] Foreign Application Priority Data

Apr. 25, 1988 [AT] Austria ..... 1040/88

[51] Int. Cl.[5] ..... E01F 9/04; E01F 9/10

[52] U.S. Cl. ..... 404/94; 111/113

[58] Field of Search ..... 404/93, 94, 73; 111/89–91, 104, 109, 114, 14, 15, 27, 30, 52, 59, 112, 113

[56] References Cited

U.S. PATENT DOCUMENTS

| | | | |
|---|---|---|---|
| 1,973,176 | 9/1934 | Richardson | 404/94 X |
| 3,103,186 | 9/1963 | Saifuku | 111/89 X |
| 4,133,274 | 1/1979 | Orth et al. | 111/104 |
| 4,444,130 | 4/1984 | Ray | 111/52 |

*Primary Examiner*—Stephen J. Novosad

*Attorney, Agent, or Firm*—Kurt Kelman

[57] ABSTRACT

To permit an efficient and inexpensive setting of marker plugs for ground marking, a setting apparatus is provided, which is mounted on an intermittently operable chassis and comprises a piercer, a plug magazine and a plug setter, wherein the piercer leads the plug setter with a predetermined spacing and the chassis is advanced in steps corresponding to said spacing.

3 Claims, 1 Drawing Sheet

APPARATUS FOR SETTING MARKER PLUGS

BACKGROUND OF THE INVENTION

1 Field of the Invention

This invention relates to an apparatus for setting marker plugs for ground marking, particularly on playgrounds, which marker plugs comprise a setting portion adapted to be set into the ground and a marking portion which is intended to rise from the ground.

2 Description of the Prior Art

Marker plugs having a bladelike setting portion and a brushlike marking portion have been disclosed in Austrian Patent Specification 371,019 and can be placed in rows to provide marking lines which have a desired course, are readily visible and are durable and resistant to atmospheric influences. They need no maintenance and do not constitute dangerous obstacles on the ground. For this reason such marker plugs are particularly useful for marking on playgrounds, particularly grassplots, as well as for providing marking patterns, inscriptions and advertising pictures on the ground or on lawns. It has previously been necessary to set such marker plugs by hand in a very time-consuming and toilsome operation involving a high labor cost. This fact has previously restricted the practical use of such marker plugs for numerous purposes.

SUMMARY OF THE INVENTION

For this reason it is an object of the invention to provide an apparatus which is of the kind described first hereinbefore and which permits an economical and exact provision of ground marking.

That object is accomplished in accordance with the invention in that a setting unit is mounted on an intermittently operable chassis and comprises a piercer, a plug magazine and a plug setter, wherein the piercer leads the plug setter with a predetermined spacing and the chassis is advanced in steps corresponding to said spacing. By means of the setting unit comprising a piercer and a plug setter the marker plugs can be set uniformly and to an adequate depth regardless of the conditions of the ground or grassland because the plugs can be forced readily and with simple means into the slots which have been cut into the ground by the piercer. The depth to which the plugs are set will be determined by the depth of penetration of the piercer into the ground. By the cutting of the shots and the insertion of the plugs the ground surface or turf is only slightly severed as the plugs are set. As a result, the plugs will be firmly and durably held in the ground. The intermittent operation of the chassis will be so controlled that after each step the setting portion will exactly be disposed at the previous location of the piercer and will be able to properly force the marker plug into the slot formed in the ground by the piercer. Because the chassis is stopped after each step, the piercer and the plug setter will be operated only when the chassis is at a standstill. This will ensure a proper coordination of the operations of the piercer and the setter and even a relative movement of the ground and the setting apparatus will not result in disturbances or damage. It will be understood that more than one marker plug can be set after each step of the chassis because a plurality of slots in the ground can be formed at the same time and a plurality of plugs can be set at the same time if the piercer and the setter comprise corresponding pluralities of piercing devices and setting devices. In that case the chassis can be controlled to advance in steps which correspond to a desired plurality of plug spacings and a plurality of plugs can then be set one behind the other at the same time. Besides, two or more plugs can be set one beside the other at the same time if the setting unit is properly extended. The design of the marker plug is not essential. Individual plugs similar to a painter's brush may be set just as plugs which are similar to elongate brushes. The pattern of the plugs which are set after each step of the chassis can also free freely be chosen so that any desired marking pattern can be provided in an efficient manner.

If the chassis carrying the setting unit constitutes a self-propelled vehicle, the entire vehicle must be moved in suitable steps. Alternatively the chassis may consist of a carriage, which is mounted on a self-propelled vehicle for a movement relative to said vehicle in its direction of travel and said carriage may be intermittently operable by the drive means of the vehicle so that the vehicle can be continuously driven and the intermittent operation of the chassis may be effected by a carriage movement which is superposed on the travel of the vehicle. In order to ensure a relative standstill of the setting unit the carriage must be driven opposite to the direction of travel of the vehicle during the piercing and setting operations and a standstill and a reverse movement of the carriage in alternation will result in suitable steps of the carriage relative to the ground In a particularly desirable embodiment of the invention the chassis carries a cross-slide which carries the setting unit so that the plugs can be placed at laterally offset locations after successive steps of the chassis. The range of modes and patterns in which the marking plugs can be set can thus be increased in a simple manner.

Within the scope of the invention the piercer may consist of at least one piston-cylinder unit and a vertically movable piercing tool this will provide the setting unit with a robust piercer, which is reliable and rapid in operation.

A desirable design for the plug setter will be obtained within the scope of the invention if the plug setter consists of at least, one piston-cylinder unit and a setting ram, which is adapted to be pushed into a vertical and portion of a plug chute, which is arranged to receive plugs from the plug magazine and is provided near its lower end with a plug-catching shutter, which is adapted to be opened and consists of a brush shutter, lip shutter or gate shutter, and the setting ram carries at its lower end a setting punch, which is adapted to be supported by the setting portion of each plug in the vertical discharge and portion of the chute. The plugs are individually discharged into the tubular chute and when the setting ram has been retracted fall freely into the end section of the chute and are caught and held therein in a pre-setting position by the plug catcher. To set the plug, the piston-cylinder unit will then be actuated by an application of pressure to extend the setting ram so that the setting punch will force the plug into the slot formed in the ground unter the end section of the chute when the plug catcher has been opened. When the setting ram is then retracted the plug setter will be ready for the next setting operation. Brush and lip shutters will constitute automatically openable plug catchers. Gate shutters must be intermittently operated with a proper timing. The plug chute constitutes a simple device for feeding plugs in the plug setter. The chute may be supplied with plugs from the plug magazine in any desired manner and that supply may be effected by ejectors or other means selected in dependence on the type of the plug magazine.

DETAILED DESCRIPTION OF THE PREFERRED EMBODIMENT

Figure 2:
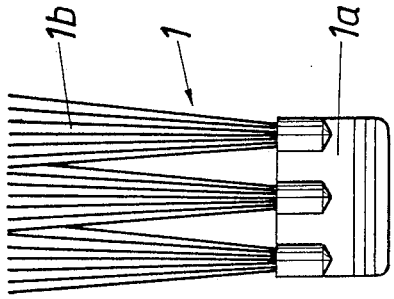
FIG. 2 is a side elevation showing a marker plug which can be placed by that setting apparatus.
Figure 1:
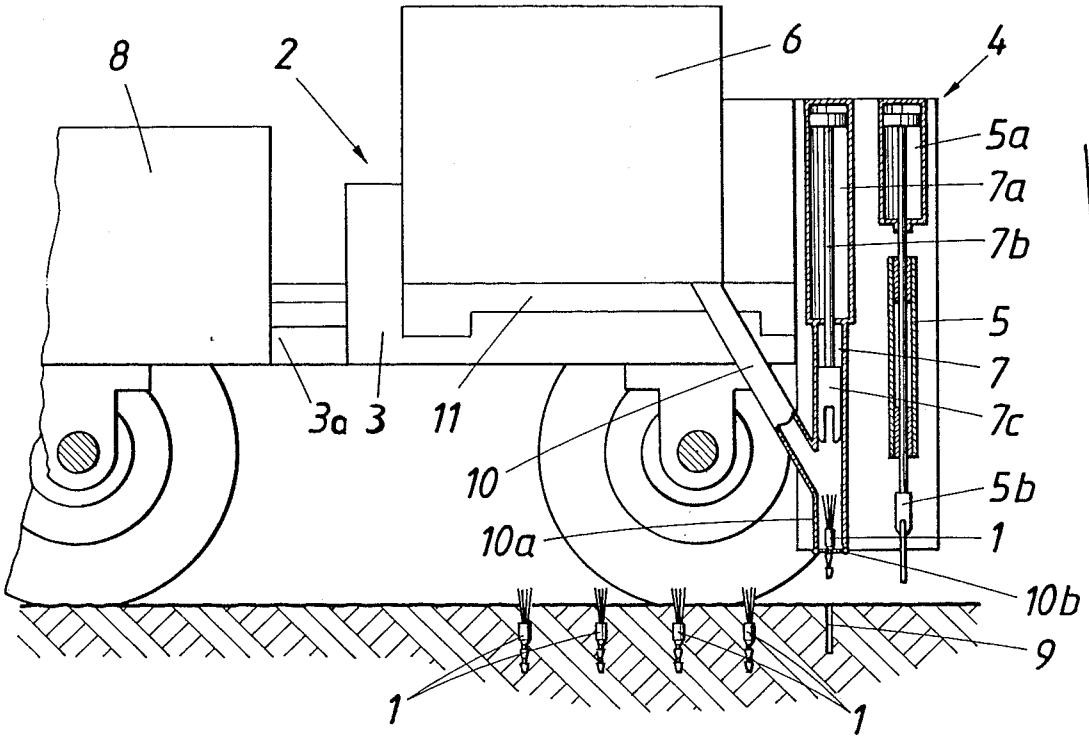
FIG. 1 is a diagrammatic representation of a setting apparatus which embodies the invention.

An illustrative embodiment of the invention will now be described more in detail with reference to the drawing.

To make a ground marking which is particularly suitable for grassplots and which is durable, resistant and requires no maintenance, a plurality of individual marking plugs 1 are arranged in a predetermined pattern, e.g., in a row. Each of said plugs comprises a bladelike setting portion 1*a* that is to be inserted into the ground and a marking portion 1*b*, which has the shape of an elongate brush and is intended to rise from the ground. The marking portions 1*b* have desired colors and in their entirety, in dependence on the pattern in which they have been set, provide the desired ground marking or other pictures or inscriptions on the ground.

For an efficient setting of the marker plugs 1, an apparatus 2 is provided which comprises a self-propelled vehicle 3*a* and a carriage 3 whereon there is mounted a setting unit 4 that comprises a piercer 5, a plug magazine 6 and a plug setter 7. The piercer 5 leads the plug setter 7 with a spacing in the direction of travel of the vehicle and the drive means 8 of the vehicle are also adapted to intermittently advance the carriage in steps corresponding to the spacing between the piercer 5 and the plug setter 7, transmission 3*b* connecting drive mean 8 to carriage 3.

The piercer 5 comprises a piercing tool 5*b*, which is vertically movable and is operable by a hydraulic piston-cylinder unit 5*a* to form slots 9 in the ground in a shape that conforms to the setting portion 1*a* of each marker plug 1. Each marker plug 1 is then forced into one of said slots 9 to a desired depth by the plug setter 7. For that purpose the plug setter 7 comprises a setting ram 7*b*, which is reciprocable by a hydraulic piston-cylinder unit 7*a* and which at its lower end carries a setting punch 7*c*. The setting cam 7*b* cooperates with a plug chute 10, which is arranged to receive consecutive marker plugs 1 from the plug magazine 6 and comprises a vertical lower end section 10*a*, which is adapted to receive the setting punch 7*c* of the setting ram 7*b* so that said punch will engage a marker plug 1 contained in said end section 10*a*. Near its lower end, the end section 10*a* is provided with a plug catcher 10*b*, which consists of a brush shutter or lig shutter and which in response to an application of pressure opens outwardly and automatically closes when it is relieved from load. The piston-cylinder unit 7*a* is also operable to retract the setting ram 7*b* from the end section 10*a*.

To set the marker plugs 1, the carriage 3 is intermittently operated to advance in steps. When the carriage is at a standstill after each step, the piercer 5 is operated to cut a slot 9 into the ground and the plug setter 7 forces a marker plug 1 into a previously cut slot 9. By dispensing means, not shown, marker plugs 1 are moved one at a time from the plug-magazine 6 into the plug chute 10 and when the setting ram 7*b* has been retracted from the chute 10 fall in said chute into its end section 10*a*, where they are caught and held in a pre-setting position by the plug catcher 10*b*. To set a plug which is in said pre-setting position, the piston-cylinder unit 7*a* is operated to force the setting ram 7*b* into the end section 10*a* so that the punch 7*c* engages the marker plug 1 end forces the latter through the plug catcher 10*b* into the slot 9 that has previously been cut into the ground. Because the carriage is advanced in steps which correspond to the spacing of the piercer 5 and the plug setter 7, the end section 10*a* will be exactly in vertical alignment with a previously cut slot 9 in the ground after each step of the carriage 3 so that a proper setting of the marker plugs 1 will be ensured.

The piercer 5 and the plug setter 7 may be so arranged and designed that the marker plugs can be set with any desired orientation relative to the direction of travel of the carriage 3. The range or setting patterns may further be increased in that the setting unit 4 is mounted on a cross-slide 11 of the carriage 3 so that the advance of the carriage and the movement of the cross-slide may be superimposed in such a manner that consecutive marker plugs 1 generally arranged in a row will be laterally offset from each other.

I claim:

1. An apparatus for setting marker plugs for ground marking, each plug comprising a setting portion adapted to be set into the ground and a marking portion adapted to rise from the ground, the apparatus comprising (a) a self-propelled vehicle;

(b) drive means for propelling said vehicle relative to the ground in a direction of travel;

(c) a carriage mounted and movable on said vehicle in said direction of travel, (2) the carriage being operatively connected to said drive means for intermittently moving said carriage relative to said vehicle and the ground in said direction of travel in steps of predetermined length; and (d) a setting unit carried by said carriage and comprising (1) a plug magazine, (2) a piercer and (3) plug setter, the plug setter leading the piercer in said direction of travel at a spacing that is equal to the length of said steps.

2. An aparatus for setting marker plugs for ground marking, each plug comprising a setting portion adapted to be set into the ground and a marking portion adapted to rise from the ground, the apparatus comprising (a) chassis intermittently movable relative to the ground in a predetermined direction in steps of a predetermined length;

(b) a cross-slide mounted on said chassis for a movement relative thereto in a direction extending transverse to said predetermined direction; and (c) a setting unit mounted on said cross-slide and comprising (1) a plug magazine, (2) a piercer and (3) a plug setter, the plug setter leading the piercer in said predetermined direction at a spacing that is equal to the length of said steps.

3. The apparatus set forth in claim 2, which comprises means for moving said cross-slide in said transverse direction in response to said intermitted operation of said chassis.

* * * * *